US005746360A

United States Patent [19]

Chen

[11] Patent Number: 5,746,360

[45] Date of Patent: May 5, 1998

[54] COAT HANGER BAG

[76] Inventor: Chin-Lai Chen, 93, Chungliao St., Sanchung, Taipei, Taiwan

[21] Appl. No.: 824,196

[22] Filed: Mar. 26, 1997

[30] Foreign Application Priority Data

Jul. 20, 1996 [TW] Taiwan ..... 85211116

[51] Int. Cl.[6] ..... A47G 25/54; A47G 25/14; B65D 85/18

[52] U.S. Cl. ..... 223/85; 223/94; 223/1; 206/287

[58] Field of Search ..... 223/85, 88, 92, 223/94, 89, 87; 206/286, 287

[56] References Cited

U.S. PATENT DOCUMENTS

| | | | |
|---|---|---|---|
| 2,705,377 | 4/1955 | Konstandt | 223/88 |
| 2,755,013 | 7/1956 | Beede | 206/287 |
| 2,781,893 | 2/1957 | Smith | 206/287 |
| 3,469,679 | 9/1969 | Kamins | 206/287 |
| 4,282,911 | 8/1981 | Sumitomo | 223/88 |
| 5,601,219 | 2/1997 | Chen | 223/85 |

FOREIGN PATENT DOCUMENTS

| | | | |
|---|---|---|---|
| 1558384 | 4/1990 | U.S.S.R. | 223/85 |

*Primary Examiner*—Bibhu Mohanty
*Attorney, Agent, or Firm*—Bacon & Thomas

[57] ABSTRACT

A coat hanger bag is provided which comprises a pressure bag, a press bar, a hanger member, puller body, a hook, a coat hanger, and a spring. The coat hanger bag is characterized in that the said coat hanger formed as a whole with the pressure bag. The coat hanger bag having a bore provided on its upper part for threadedly securing with the puller body and a receiving space formed on its lower part for receiving hanger member. A moving member is provided within the body of the hanger member. In operation, the sucking tube is threaded into the bore of the coat hanger thereby applying a force on the upper plate which presses the spring and thus, the lower plate is moved downwardly away from the plate of the body and thus, the air within the bag is allowed to flow out of the bag so as to accomplish the object of making a vacuum coat hanger bag.

6 Claims, 5 Drawing Sheets

COAT HANGER BAG

FIELD OF THE INVENTION

The present invention relates to a hanger bag and more particularly to an improved coat hanger bag structure which is space saving for storage as well as bug proof.

BACKGROUND OF THE INVENTION

Coat hanger bags are widely used for storing clothes. Conventionally, a coat hanger bag is convenient to press the object such as a coat into a minimum storage space. However, it only allows longitudinal storage without providing means to store clothes in lateral way. Further, clothes are prone to be wrinkled due to being folded for longitudinal storage.

The present invention can advantageously overcomes the above drawbacks of prior art.

SUMMARY OF THE INVENTION

It is therefore an object of the present invention to provide an improved coat hanger bag which generally comprises a pressure bag, a press bar, a hanger member, a puller body, a hook, and a coat hanger. The coat hanger bag of the present invention is characterized in that it provides a means to store clothes in lateral way such that saving space for storage and bug proof. Additionally, the coat hanger bag is characterized in its simple structure, quick suction operation and automatic sealing.

It is another object of the present invention to provide an improved coat hanger bag which characterized in that a sucking tube is threaded into the bore of the coat hanger thereby applying a force on the upper plate which presses the spring and thus, the lower plate is moved downwardly away from the plate of the body of the hanger member so as to begin the sucking process. When air within the bag is substantially vacuum, then threads the puller body out of the bore and removes the sucking hole away from the puller body which causing the moving, member to move upwardly to its normal position by means of the expansion force of the spring, so as to accomplish the object of making a vacuum bag.

It is still another object of the present invention to provide an improved coat hanger bag which characterized in that a threaded hole is provided on the central rod such that when completing the the vacuum process of the coat hanger bag, a hook is allowed to be threadly secured to the central rod of the moving member of the hanger member for hanging, the coat hanger bag in a suitable place, such as a wardrobe.

The above and other objects, features and advantages of the present invention will become apparent from the following detailed description taken with the accompanying drawings.

DETAILED DESCRIPTION OF THE PREFERRED EMBODIMENTS

Figure 1:
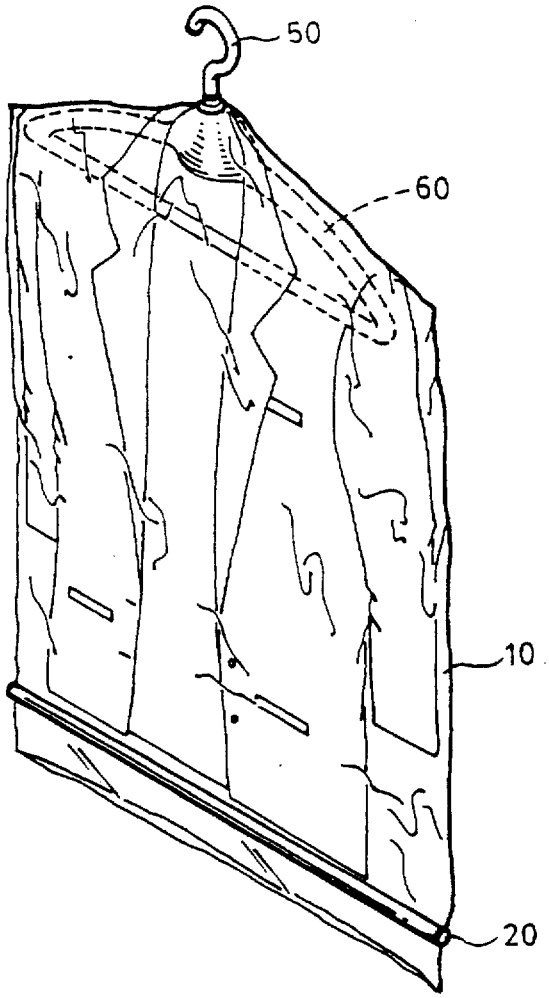
FIG. 1 is a perspective view of a coat hanger bag of the present invention.
Figure 2:
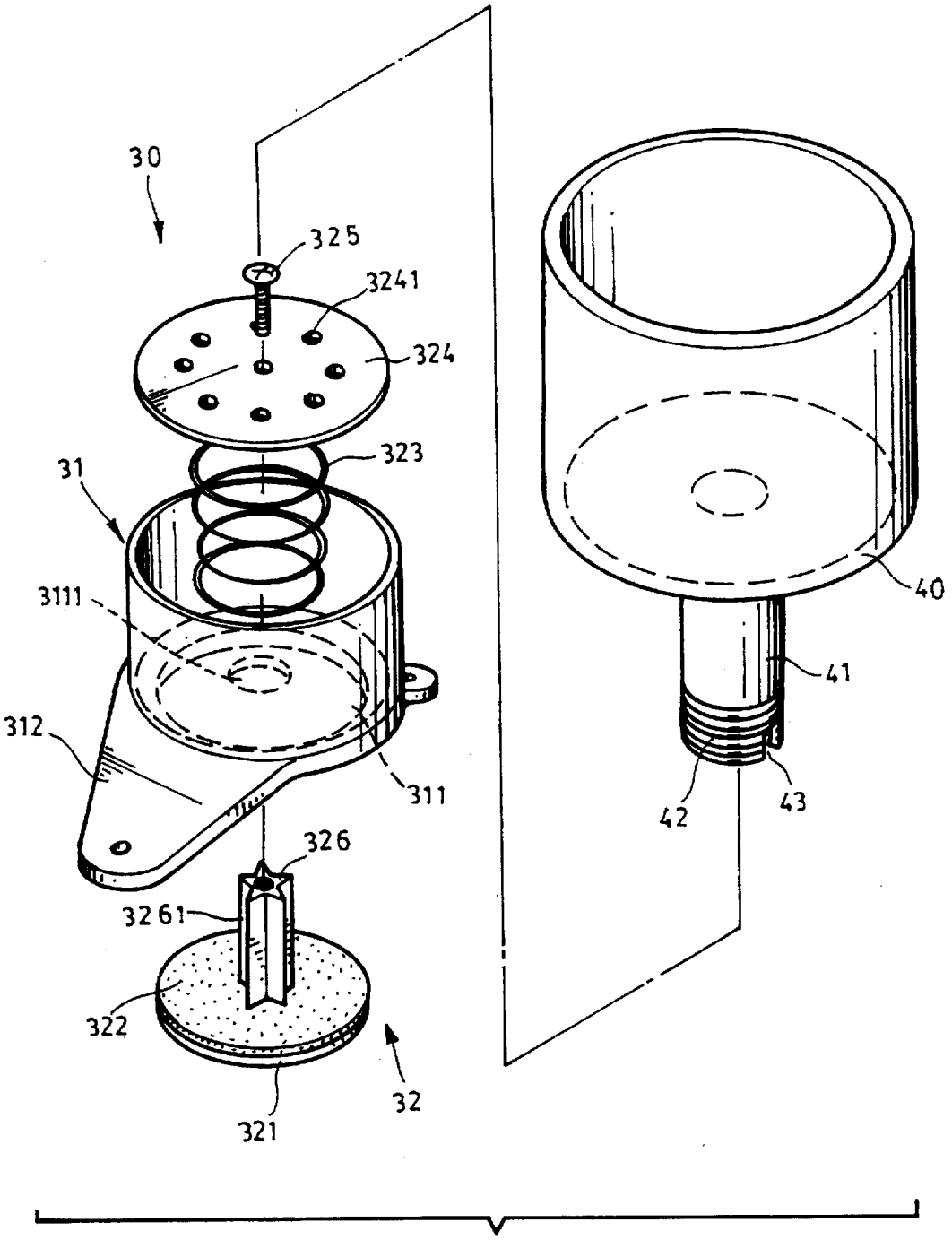
FIG. 2 is an exploded view of a hanger member of the present invention.

Referring to FIGS. 1–2, the coat hanger bag of the present invention generally comprises a pressure bag 10, a press bar 20, a hanger member 30, a puller body 40, a hook 50, and a coat hanger 60. The coat hanger 60 is formed as a whole with the pressure bag 10. The bottom opening of the pressure bag 10 is sealed by the press bar 20 as shown in FIG. 1 which is a preferred embodiment wherein a suit is supported by a coat hanger bag of the present invention.

Figure 3:
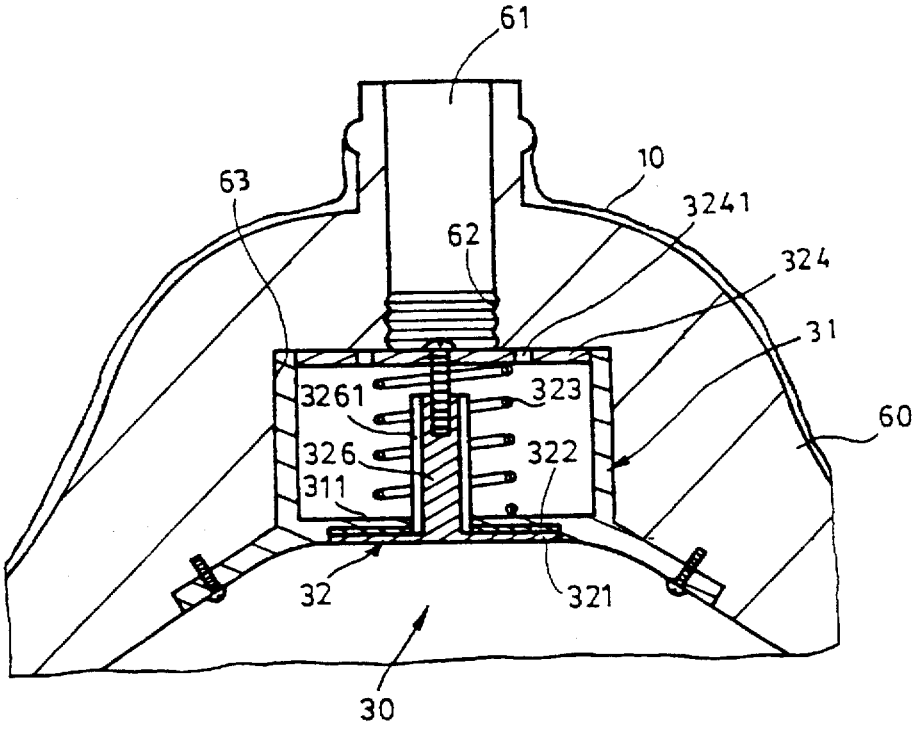
FIG. 3 is a schematic diagram showing the assembly of the hanger member and a coat hanger.

Referring to FIGS. 2–3, the hanger member 30 is disposed within a receiveing space 63. A bore 61 extends from the top of the receiving space 63 wherein a female screw threaded portion of the coat hanger 60 is provided around the lower part of the bore 61. A sucking tube 41 with a male screw threaded portion 42 formed on the lower part of its outer peripheral surface extends from the bottom of the puller body 40. The sucking tube 41 is threaded into the bore 61 wherein the length of the sucking tube 41 is longer than the depth of the bore 61 in order to push the hanger member 30 downwardly such that an air path is allowed to be formed through a pair of openings 43 which formed the bottom of the sucking 41.

The hanger member 30 comprises a body 31 and a moving member 32. The cylinder shaped body 31 has a pair of oppositely disposed flanges 312 formed on the bottom of its outer surface in which a screw threaded hole provided on each of the two flanges 312. The body 31 is secured to the coat hanger 60 by threading a pair of screws through each hole of the two flanges 312. A plate 311 with a central hole 3111 is provided on the bottom of the body 31 for defining, the axial movement of the moving member 32, which located below the body 31. The moving member 32 acts as to control the air path. A spring, 323 is located within the body 31. In normal condition, the spring 32 is compressed against the upper plate 324. A plurality of holes 3241 equidistantly spaced each other around a central hole 3241 are formed on the upper plate 324. A peripheral slot 3261 is formed on the body of the central rod 326. The diameter of the central hole 3111 substantially conforms to the central rod 326 which has a star shaped cross section as viewed from the top. A threaded hole is formed on the center of the central rod 326 in order to receive a screw 325 which threaded through the central hole 3241 of the upper plate 324 and the central rod 326 such that the upper plate 324 and lower plate 321 are secured. The central rod 326 and the lower plate 321 are formed as a whole. A pad 322 is provided on the top of the lower plate 32. The lower plate 321, which under the downward expansion force of the spring 323, are abutted under the plate 31 of the body 31 such that airtightness within the pressure bag 10 is maintained.

Figure 4:
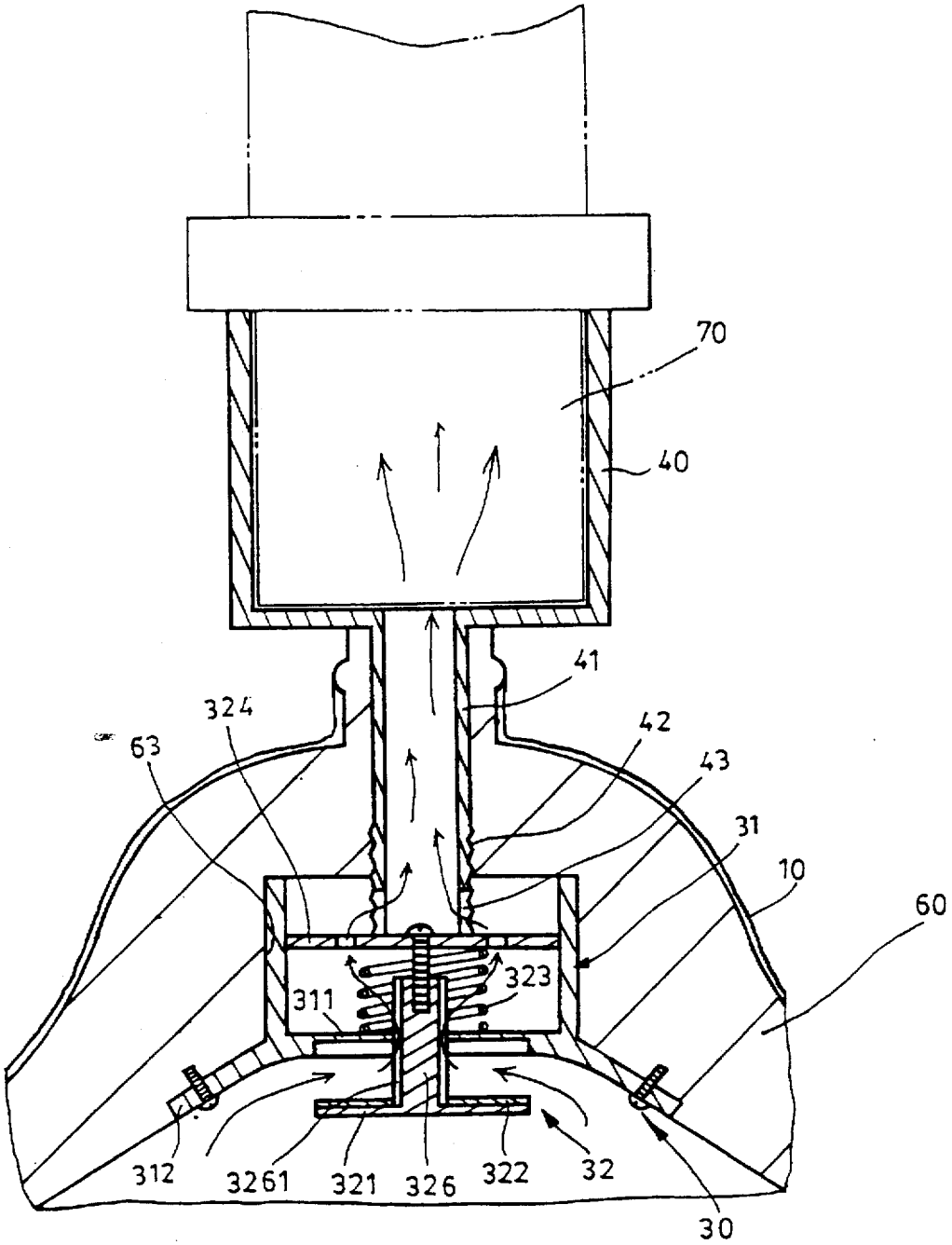
FIG. 4 describes the operation of a puller body on the hanger member.
Figure 5:
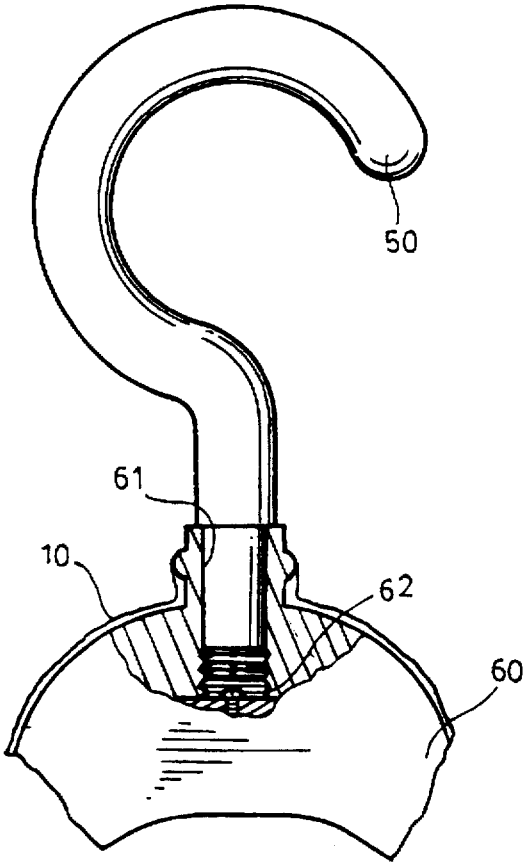
FIG. 5 is a partial sectional view of a hook of the present invention.

Referring to FIG. 4, which describes the operation of a puller body 40 on the hanger member 30. Firstly, the sucking tube 41 is threaded into the bore 61 of the coat hanger 60 thereby applying a force on the upper plate 324 which presses the spring 323 and thus, the lower plate 321 is moved downwardly away from the plate 311 of the body 31. Secondly, the air within the bag is allowed to flow through the slot 3261, the holes 3241 of the upper plate 324, the openings 43 of the sucking tube 41, and the sucking hole 70 and finallly sucked out of the pressure bag 10. When the pressure bag 10 is substantially vacuum, then threads the puller body 40 out of the bore 61 and removes the sucking hole 70 away from the puller body 40 which causing the moving member 32 to move upwardly to its normal position by means of the expansion force of the spring 323 so as to accomplish the object of sealing the pressure bag 10. At this point, thread the hook 50 into the bore 61 and thus, complete the the vacuum process of the coat hanger bag and finally hang the bag in a suitable place, such as a wardrobe.

While the invention herein disclosed has been described by means of specific embodiments, numerous modifications and variations could be made thereto by those skilled in the art without departing from the scope of the invention set forth in the claims.

I claim:

1. A coat hanger bag comprising a pressure bag, a press bar to close the hanger body, a hanger member, a puller body, and a coat hanger:

the coat hanger attached to the pressure bag, the coat hanger having a bore provided on a upper part thereof and a receiving space formed on a lower part thereof, wherein a female screw threaded portion is provided around the lower part of the bore;

a sucking hole located within the puller body which a sucking tube with a male screw threaded portion formed on a lower part of the outer peripheral surface extending from the bottom of the puller body, and wherein a pair of openings are formed on the bottom of the sucking tube and the length of the sucking tube is longer than the depth of the coat hanger bore;

the hanger member comprising a body and a moving member, wherein a plate with a central hole is provided on the bottom of the body for defining the axial movement of the moving, member which has an upper plate with a plurality of holes engaged against the bore of the coat hanger, and wherein a peripheral slot is formed on the body of a central rod which formed as a whole with a lower plate of the moving member;

a hook threaded and secured to the bore of the coat hanger; and a spring located within the hanger member wherein body in normal condition the spring is compressed against the upper plate and the lower plate respectively in order to keep the airtightness and in operation, the sucking tube being threaded into the bore of the coat hanger thereby applying a force on the upper plate which presses the spring and thus, the lower plate is moved downwardly away from the plate of the body and thus, the air within the bag is allowed to flow through the slot, a plurality of holes of the upper plate, two openings of the sucking tube, and the sucking hole and then sucked out of the pressure bag.

2. The coat hanger bag of claim 1, wherein a pad is provided on the top of the lower plate of the moving member.

3. The coat hanger bag of claim 1, wherein a plurality of holes equidistantly spaced each other around a central hole are formed on the upper plate of the moving member.

4. The coat hanger bag of claim 1, wherein the central rod has a star shaped cross section as viewed from the top.

5. The coat hanger bag of claim 1, wherein the hanger member has a pair of oppositely disposed flanges formed on the bottom of its outer surface in which a screw threaded hole is provided on each of the two flanges.

6. The coat hanger bag of claim 5, wherein the hanger member is secured to the coat hanger by threading a pair of screws through each hole of the two flanges.

* * * * *